US011655814B2

(12) United States Patent
Agostini et al.

(10) Patent No.: US 11,655,814 B2
(45) Date of Patent: May 23, 2023

(54) PROGRESSIVE CAVITY PUMP FOR THE TINTOMETRIC INDUSTRY

(71) Applicant: Leandro José Agostini, Porto Alegre (BR)

(72) Inventors: Leandro José Agostini, Porto Alegre (BR); Marcelo Angelo Taparello de Souza, São Leopoldo (BR)

( * ) Notice: Subject to any disclaimer, the term of this patent is extended or adjusted under 35 U.S.C. 154(b) by 155 days.

(21) Appl. No.: 17/264,182

(22) PCT Filed: Mar. 13, 2020

(86) PCT No.: PCT/BR2020/050089
§ 371 (c)(1),
(2) Date: Jan. 28, 2021

(87) PCT Pub. No.: WO2020/186324
PCT Pub. Date: Sep. 24, 2020

(65) Prior Publication Data

US 2021/0172438 A1 Jun. 10, 2021

(30) Foreign Application Priority Data

Mar. 15, 2019 (BR) ..... 1020190051140

(51) Int. Cl.
*F04C 2/10* (2006.01)
*F01C 1/10* (2006.01)
*F04C 2/107* (2006.01)

(52) U.S. Cl.
CPC ..... *F04C 2/107* (2013.01); *F04C 2240/20* (2013.01); *F04C 2240/30* (2013.01); *F04C 2240/60* (2013.01)

(58) Field of Classification Search
CPC .... F04C 2/107; F04C 2/1075; F04C 2250/30; F01C 1/101
See application file for complete search history.

(56) References Cited

U.S. PATENT DOCUMENTS 3,084,631 A * 4/1963 Bourke ..... F04C 2/1075 418/48
5,688,114 A 11/1997 Millington et al.
7,553,139 B2 * 6/2009 Amburgey ..... F04C 15/0069 418/152

FOREIGN PATENT DOCUMENTS

BR PI9710835-9 A 4/1997
BR PI0501760 B1 1/2006
(Continued)

OTHER PUBLICATIONS

Instituto Nacional Da Propriedade Industrial; International Search Report; dated Apr. 22, 2020; all pages.

*Primary Examiner* — Deming Wan
(74) *Attorney, Agent, or Firm* — Price Heneveld LLP

(57) ABSTRACT

The present invention refers to a progressive cavity pump developed for tintometric dosing machines. The proposal set out in the present invention is to make precision dosages through pumping by just one stator and rotor stage. The PCP proposal enhances the traditional constructive arrangement for tintometric application. The object makes precision dosages through pumping by just one stator and rotor stage, reducing the length of the pump, facilitating the manufacture of its components and requiring less robustness of the transmission components and of the drive motor. Therefore, the present invention has a simplified transmission system, uses special geometry for fastening the stator, optimizes the bearing of the drive shaft and its sealing element, reduces the dimensions of the components and uses a low torque motor.

7 Claims, 2 Drawing Sheets

(56) References Cited

FOREIGN PATENT DOCUMENTS

| | | | |
|---|---|---|---|
| BR | PI0916680-7 | A2 | 11/2015 |
| DE | 19801020 | A1 | 7/1999 |
| EP | 1650403 | A1 | 4/2006 |

* cited by examiner

PROGRESSIVE CAVITY PUMP FOR THE TINTOMETRIC INDUSTRY

BACKGROUND OF THE INVENTION

The present invention refers to a progressive cavity pump developed for tintometric dosing machines. The proposal set out in the present invention is to make precision dosages through pumping by just one stator and rotor stage.

A progressive cavity pump (PCP) is classified as a positive dislocation pump (also referred to as volumetric). This pump is a variation of the single screw pump. It is comprised of a rotor in the form of helical screw and a stator made of natural or synthetic elastomer, specified based on the chemical composition and temperature of the fluid to be pumped (HENN, 2006, pages 421 and 422).

PCPs traditionally follow a constructive arrangement for application in works of high pressure differential and large flow rate, presenting themselves as large multistage pumps, consequently requiring high drive torque, robust and high energy-consuming transmission systems. Its stators are generally cylindrical, vulcanized in metal shirts or mounted and need radial locking. One example of this harsh application is in the petroleum industry, for artificially rising deep oil wells.

However, in the tintometric application, the pump does not need to provide high pressures to transfer the concentrated paint from the reservoir of the dosing machine to the spout, enabling it to function with just one stage, decreasing the drive torque, resulting in simplified transmission, assembly, capacity of the motor, etc.

The consequences of the traditional constructive arrangement include problems with premature wear, gripping and low energy efficiency.

Patent PI 0501760-2 B1 proposes a mechanical solution of fastening the stator which applies to large pumps used in harsh works, such as artificial rising of oil, to solve the problem of radial fastening due to the high torque. This model values the fixing guarantee, while it compromises maintenance. Since shirt and stator become one sole part and need to be replaced together.

Patent PI 0916680-7 A2, developed focused on easy maintenance, is only applicable to large pumps, its constructive arrangement not being viable for small flow pumps.

Patent PI 9710835-9 A proposes a concept of flexible shaft to eliminate the universal joint, owing to the kinetic difference between rotor and shaft. However, its application should be evaluated according to the chemical characteristic of the working fluid, and in some cases may not be compatible.

The solutions proposed in the state of the art present problems of part wear, such as gripping and clogging. Besides increasing the amount of corrective and preventive maintenance, these problems decrease the useful life of the pump.

SUMMARY

The PCP proposal enhances the traditional constructive arrangement for tintometric application. The object makes precision dosages through pumping by just one stator and rotor stage, reducing the length of the pump, facilitating the manufacture of its components and requiring less robustness of the transmission components and of the drive motor.

Therefore, the present invention has a simplified transmission system, uses special geometry for fastening the stator, optimizes the bearing of the drive shaft and its sealing element, reduces the dimensions of the components and uses a low torque motor.

BRIEF DESCRIPTION OF THE DRAWINGS

For an improved understanding of the components and the technical characteristics of the progressive cavity pump developed for tintometric dosing machines, object of the present invention, accompanying drawings are presented, wherein.

DETAILED DESCRIPTION OF THE PREFERRED EMBODIMENTS

Figure 1A:
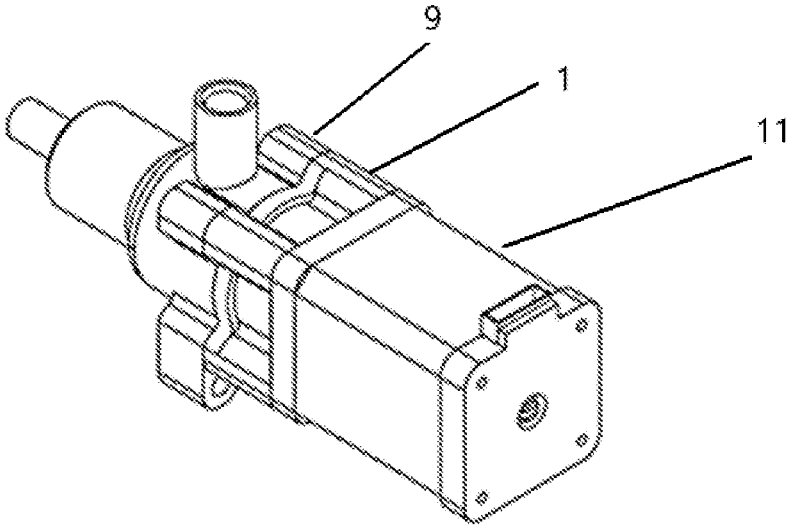
FIG. 1A represents a perspective view of the PCP, where it is possible to see the upper body (9), the step motor (11) and the bearing (1)
Figure 1B:
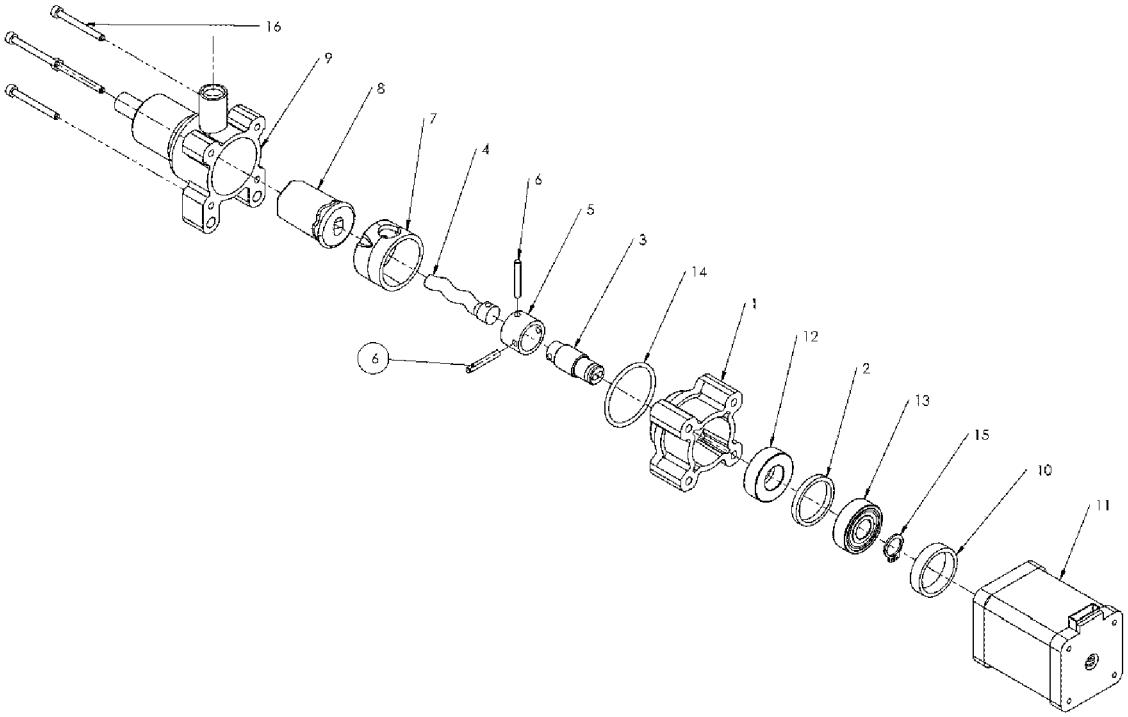
FIG. 1B represents a blown-up perspective view of the PCP, where it is possible to see all the parts that make up the PCP.
Figure 2:
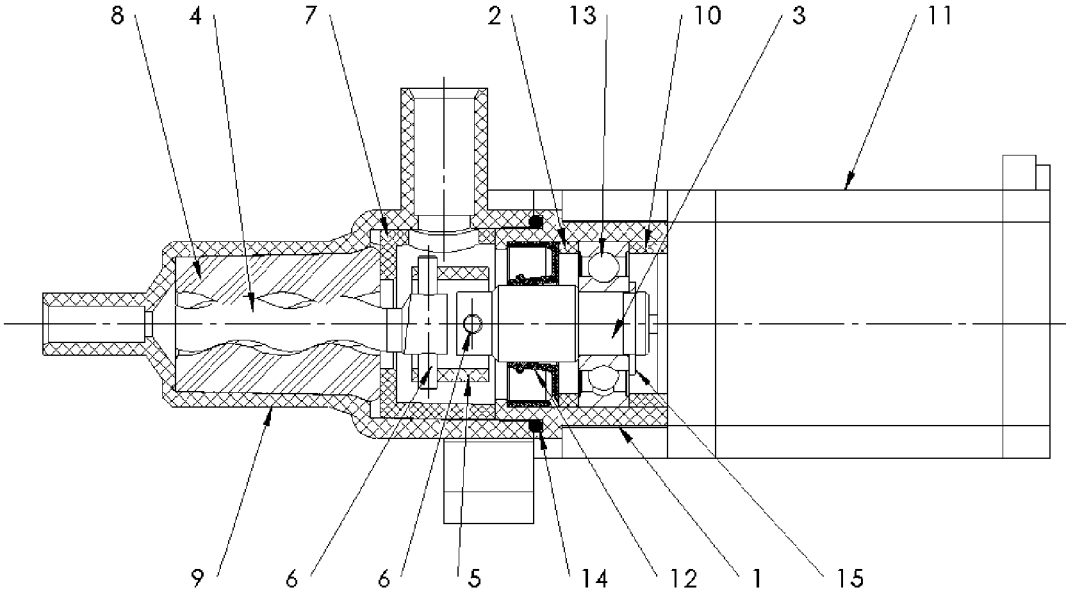
FIG. 2 represents a cutaway view of the PCP.

In a plastic shell, referred to as upper body (9) (FIGS. 1A-2), obtained by injection process, the fluid input and output channels are present. These channels have housings for snap insertion of plastic hoses, dispensing with the use of threaded connections. This shell has cone-shaped internal housing, having over four sides, for assembling the stator (8) and, subsequently, cylindrical with two small radial locks for assembling a spacer (7). The hexagonal geometry of the housing of the stator results in its radial locking. The hoses are fastened by the dimensional interference relationship between the inner diameter of the housing and the outer diameter of the hose.

The rotor (4) is produced by machining a round bar made of metal or polymer material, depending on the application. Same has a circular section of a certain eccentricity along a helical step. Its helical length is 2 steps, which form 1 stage in a PCP. In it there is a small cylindrical, non-helical section to facilitate the dimensional evaluation of the circular section. At the opposite end to the start of the helicoid, the raw material is maintained with the gross dimension of the round bar. At this site there is a small-diameter transversal hole, used for assembly of a pin on one of the sides of the universal joint which transmits the torque of the shaft. This component was developed with dimensions compatible for working with precision in a broad flow range for tintometric production.

The stator (8) is manufactured of injected or vulcanized elastomer, according to its application. This component is externally cone-shaped with over four sides for seal-tight housing in the shell, described previously, and the helical oblong inner cavity has a geometry consistent to form the pair with the rotor (4). The front face has a semicircular section ring, similar to an o'ring, but coupled to the part, for compression and sealing.

The plastic bearing (1), produced by injection, houses a simple-lip commercial retainer (12), type R5, a spacer (2), a rigid bearing (13) and another spacer (10), in this order. This bearing (1) has internal cylindrical housing on one of its sides. The other side has a channel for positioning an o'ring (14), for sealing on the assembly against the upper body (9). Also on the same side is a circular protrusion, as a form of guiding its assembly on the upper body (9) and compressing the spacer cup (7) of the stator.

The spacers (2,10) used in the bearing are plastic, produced by injection. The function of one of the spacers is to separate the retainer from the bearing and, the other is to fill the space between the bearing and the outer face of the bearing.

The function of the spacer cup (7) of the stator (8), plastic, obtained by injection, is to compress the stator to the bottom of the upper body (9), when latter is mounted against the bearing (1). This spacer is in the shape of a cup with a hole in the bottom, this hole being the passage for the fluid to the inner cavity of the stator.

A universal joint for transmitting torque from the shaft to the rotor is comprised of a ring (5) and two pins (6). The ring (5), plastic, obtained by the process of injection, has two holes, orthogonal to each other, for sliding the pins which are fastened on the rotor and on the shaft. The metal pins (6) are cylindrical in shape, obtained by machining process. The constructive and dimensional arrangement of this transmission set was conceived so as to present high mechanical efficiency for low consumption of torque and energy. Besides enabling a reduction in the length of the pump set, it is suitable for compact assembly of equipment.

The shaft (3) is produced by machining a round bar of metal or polymer material. This component has a cylindrical adjustment for insertion in the bearing and bearing retainer. At the end it has a small transversal cylindrical hole for fastening one of the pins of the transmission joint. The face of the other end presents an encasement for the shaft of the propulsion motor of the pump. On this same side, it is axially fastened on the back of the bearing by an elastic ring (15).

The shaft and the spacers are necessary for the constructive arrangement of the present invention, which enables optimization of the bearing of the drive shaft and its sealing element, reducing the dimensions of the components and using a low torque motor.

Lastly, the pump is closed and tightened by way of cylindrical head hexagon socket screws (16).

LIST OF NUMERICAL SIGNS

Bearing of the PCP (1)
Spacer (2)
Shaft (3)
Rotor (4)
Universal joint ring (5)
Universal joint pin (6)
Spacer cup (7)
Stator (8)
Upper body (9)
Spacer (10)
Step motor (11)
Retainer (12)
Bearing (13)
O'ring (14)
Elastic ring (15)
Screw (16)

The invention claimed is:

1. A progressive cavity pump for a tintometric closing system, comprising:

a rotor in the form of helical screw;

an elastomer stator wherein the rotor including a circular section having an eccentricity along a helical step and a helical length of two steps, which form one stage; and a plastic shell including an upper body having a fluid input channel and a fluid output channels each including housings configured for snap insertion of plastic hoses via a dimensional interference between an inner diameter of each of the housings and an outer diameter of each of the plastic hoses;

wherein the shell includes a cone-shaped internal housing having over four sides for assembly of the stator and two radial locks for assembly of a spacer.

2. The progressive cavity pump for the tintometric closing system according to claim 1, further comprising:

a transmission universal joint configured to fasten the rotor and a shaft which is operably coupled to a propulsion motor, wherein the transmission universal joint is configured to provide a high mechanical efficiency and low consumption of torque and energy.

3. The progressive cavity pump for the tintometric closing system according to claim 1, further comprising:

a rear assembly configured to lock the stator from a spacer cup, wherein the rear assembly does not use a front cover on the shell.

4. A progressive cavity pump for a tintometric closing system, comprising:

a rotor in the form of helical screw;

an elastomer stator wherein the rotor including a circular section having an eccentricity along a helical step and a helical length of two steps, which form one stage; and a plastic shell including an upper body having a fluid input channel and a fluid output channel each including housings configured for snap insertion of plastic hoses via a dimensional interference between an inner diameter of each of the housings and an outer diameter of each of the plastic hoses;

wherein the rotor includes a cylindrical, non-helical section to facilitate a dimensional evaluation of the circular section; and wherein the shell includes a cone-shaped internal housing having over four sides for assembly of the stator and two radial locks for assembly of a spacer.

5. The progressive cavity pump for the tintometric closing system according to claim 4, wherein a hexagonal geometry of the housing of the stator provides radial locking of the housing.

6. The progressive cavity pump for the tintometric closing system according to claim 5, further comprising:

a transmission universal joint configured to fasten the rotor and a shaft which is operably coupled to a propulsion motor, wherein the transmission universal joint is configured to provide a high mechanical efficiency and low consumption of torque and energy.

7. The progressive cavity pump for the tintometric closing system according to claim 6, further comprising:

a rear assembly configured to lock the stator from the spacer cup, wherein the rear assembly does not use a front cover on the shell.

* * * * *